United States Patent [19]

Keller

[11] Patent Number: 4,571,153

[45] Date of Patent: Feb. 18, 1986

[54] AXIAL-ADMISSION STEAM TURBINE, ESPECIALLY OF DOUBLE-FLOW CONSTRUCTION

[75] Inventor: Herbert Keller, Mülheim, Fed. Rep. of Germany

[73] Assignee: Kraftwerk Union Aktiengesellschaft, Mülheim, Fed. Rep. of Germany

[21] Appl. No.: 475,458

[22] Filed: Mar. 15, 1983

[30] Foreign Application Priority Data

Mar. 16, 1982 [DE] Fed. Rep. of Germany ..... 3209506

[51] Int. Cl.[4] ..... F01D 25/12; F01D 1/08

[52] U.S. Cl. ..... 415/117; 415/103

[58] Field of Search ..... 415/93, 101, 103, 116, 415/176, 178, 180, 99, 175, 117

[56] References Cited

U.S. PATENT DOCUMENTS

| | | | |
|---|---|---|---|
| 3,147,951 | 9/1964 | Cain, Jr. et al. | 415/101 |
| 3,232,580 | 2/1966 | Birmann | 415/117 |
| 3,817,654 | 6/1974 | Sohma | 415/103 |
| 3,861,821 | 1/1975 | Keller et al. | 415/101 |
| 3,994,630 | 11/1976 | Rodgers | 415/116 |

FOREIGN PATENT DOCUMENTS

| | | | |
|---|---|---|---|
| 0536533 | 1/1957 | Canada | 415/117 |
| 851531 | 10/1939 | France . | |
| 52-15907 | 2/1977 | Japan | 415/117 |
| 0159225 | 12/1932 | Switzerland | 415/117 |
| 430757 | 8/1967 | Switzerland . | |
| 469185 | 4/1969 | Switzerland . | |
| 1219994 | 1/1971 | United Kingdom | 415/101 |

OTHER PUBLICATIONS

Article from W. Traupel "Thermische Turbomaschinen", vol. 2, 2nd Ed., Springer-Verlag, Berlin, Heidelberg, New York, 1968, p. 341.

Journal "BBC-Nachrichten", 1980, No. 10, p. 378.

*Primary Examiner*—Robert E. Garrett

*Assistant Examiner*—H. Edward Li

*Attorney, Agent, or Firm*—Herbert L. Lerner; Laurence A. Greenberg

[57] ABSTRACT

An axial-admission steam turbine, includes a steam inflow region, guide vane rings including a first guide vane ring, guide vanes of the first guide vane ring having radially inner ends, a shaft being rotatable in a given direction, an annular shaft shield being connected to the radially inner ends of the guide vanes of the first guide vane ring and being disposed in vicinity of the steam inflow region, the annular shaft shield surrounding the shaft at a distance defining a ring canal therebetween, the annular shaft shield having nozzles formed therein for discharging into the ring canal tangentially relative to the shaft as seen in the given direction of rotation of the shaft.

6 Claims, 2 Drawing Figures

AXIAL-ADMISSION STEAM TURBINE, ESPECIALLY OF DOUBLE-FLOW CONSTRUCTION

Figure 1:
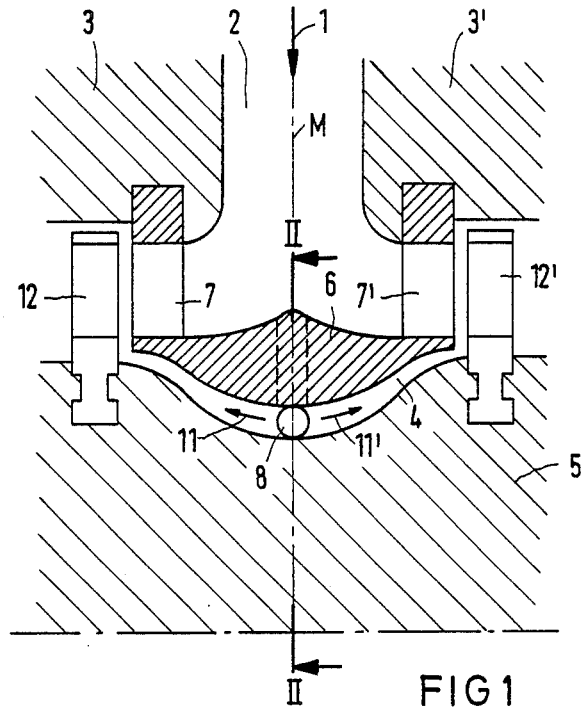

The invention relates to an axial-admission steam turbine, especially of double-flow construction, having an annular shaft shield in vicinity of the steam inflow, which surrounds the shaft at a distance and is connected to the radially inner ends of the guide vanes of the first guide vane ring.

Such a steam turbine is known from French Pat. No. 851 531. In a double-flow steam turbine shown therein, a shaft shield which is fastened to the radially inner ends of the guide vanes of the first guide vane rings of both flows, is disposed in vicinity of the steam inflow or admission which takes place in the axial center. The outer periphery of the shaft shielding which surrounds the shaft with a spacing therebetween is constructed in this case in such a way that the steam flowing in, in the radial direction, is uniformly distributed to both flows and is deflected into the axial direction. The shaft shielding thereby prevents direct exposure of the shaft surface to the steam flowing in or being admitted in the radial direction.

It is also known from W. Traupel "Thermische Turbomaschinen", Vol. 2, 2nd Ed., Springer-Verlag, Berlin, Heidelberg, N.Y. 1968, Page 341, to place a baffle in vicinity of the steam inflow and to introduce cooling steam from the outside into the ring canal formed between the shaft and the baffle, in an axial-admission single-flow steam turbine. The cooling steam then flows in the ring canal until it is in front of the first rotor blade ring. In this manner, it is possible to reduce the thermal stresses which occur, in addition to the high centrifugal stresses of the shaft, in vicinity of the steam inflow and in vicinity of the rotor blade fastening of the first rotor blade ring. However, for this purpose it is necessary to have cooling steam available, which is associated with some costs. In addition, such an introduction of cooling steam from the outside into the ring canal formed between the shaft shielding and the shaft is only possible in double-flow steam turbines if the line for the supply of the cooling steam is installed in vicinity of the steam inflow. Such a construction is known from the journal "BBC-Nachrichten", 1980, No. 10, Page 378. By installing the line for supplying the cooling steam in vicinity of the steam inflow, however, additional flow losses are generated. Cooling the shaft in vicinity of the steam inflow by cooling steam is also disadvantageous thermodynamically, because the cold cooling steam lowers the mean working temperature in the steam turbine. The supply of cool steam can, however, also create control problems in the event of load shedding, since the cool steam could make the steam turbine or the turbo-set run at excess speed unless the supply of cooling steam is shut off by separate safety valves.

It is accordingly an object of the invention to provide an axial-admission steam turbine especially of double-flow construction, which overcomes the hereinaforementioned disadvantages of the heretofore-known devices of this general type, and to reduce the thermal stresses of the shaft in the vicinity of the steam inflow without the use of cooling steam.

With the foregoing and other objects in view there is provided, in accordance with the invention, an axial admission steam turbine, especially of double-flow construction, comprising a steam inflow region, stationary guide vane rings including a first guide vane ring, guide vanes of the first guide vane ring having radially inner ends, a shaft being rotatable in a given direction, an annular shaft shield being connected to the radially inner ends of the guide vanes of the first guide vane ring and being disposed in vicinity of the steam inflow region, the annular shaft shield surrounding the shaft at a distance defining a ring canal therebetween, the annular shaft shield having nozzles or passageways formed therein for discharging into the ring canal tangentially relative to the shaft as seen in the given direction of rotation of the shaft.

In the steam turbine according to the invention, a small substream or component of the total inflowing steam is thus fed, bypassing the first guide vane ring, through tangentially disposed nozzles to the region of the shaft under the shaft shield. The velocity with which this substream enters the ring canal formed between the shaft and the shaft shield, corresponds to the gradient to be worked-up in the first guide vane ring. The nozzles placed in the shaft shield are oriented in such a way with respect to the direction of rotation of the shaft, that the rotary flow developing in the ring canal leads or runs ahead of the circumferential velocity of the shaft. The boundary layer temperature at the shaft then corresponds to the static temperature of the steam which is lowered by the increase of the kinetic energy, increased by the ram temperature component of the comparatively small relative velocity between the rotary flow and the circumferential velocity of the shaft. Through the use of the nozzles which are placed tangentially in the shaft shield, effective cooling of the shaft in vicinity of the steam inflow and in vicinity of the rotor blade fastening of the first rotor blade ring can thereby be achieved.

In accordance with another feature of the invention, the steam inflow region provides a radial flow of steam being deflected by the shaft shield into the axial direction for rotating the shaft.

In accordance with a further feature of the invention, the guide vane rings include another first stationary guide vane ring having guide vanes with radially inner ends, the steam inflow region provides a radial flow of steam being deflected by the shaft shield into two axial flows in opposite directions for rotating the shaft, each being associated with a respective one of the first guide vane rings, the shaft shield is also fastened to the radially inner ends of the guide vanes of the other first guide vane ring, and the nozzles formed in the shaft shield discharge into the ring canal at the axial center of the shaft. The substream entering the ring canal through the centered nozzles is then equally divided into two rotary flows which respectively flow in the axial direction along the shaft to the first rotor blade ring.

In accordance with an added feature of the invention, there is provided a weak reaction stage disposed downstream of the first guide vane ring.

In accordance with an additional feature of the invention, there are provided weak reaction stages respectively disposed downstream of each of the first guide vane rings.

A further improvement of the cooling effect can therefore be achieved by constructing the first stage as a weak reaction stage, or in a double-flow structure, by constructing the respective first stage as a weak reaction stage in both flows. Therefore, a gradient which is as large as possible is to be worked-up in the first guide vane ring, so that through the corresponding increase of the kinetic energy, the static temperature of the substream fed into the ring canal is lowered as far as possible.

It has further been found practical for production reasons if, in accordance with again another feature of the invention, the nozzles are in the form of four nozzles being uniformly distributed over the periphery of the shaft shield.

In accordance with again a further feature of the invention, the nozzles have a combined cross section providing a steam mass flow discharging into the ring canal being substantially 3% of the steam mass flow provided in vicinity of the steam inflow region. In this way, the increase in consumption due to the partial bypass of the first guide vane ring can be limited to extremely low values, while at the same time the shaft is cooled effectively.

Other features which are considered as characteristic for the invention are set forth in the appended claims.

Although the invention is illustrated and described herein as embodied in an axial-admission steam turbine, especially of double-flow construction, it is nevertheless not intended to be limited to the details shown, since various modifications and structural changes may be made therein without departing from the spirit of the invention and within the scope and range of equivalents of the claims.

Figure 2:
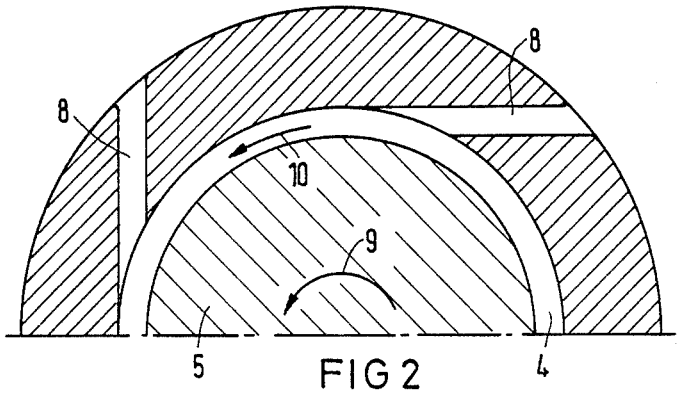

The construction and method of operation of the invention, however, together with additional objects and advantages thereof will be best understood from the following description of specific embodiments when read in connection with the accompanying drawings, in which:

FIG. 1 is a diagrammatic and greatly simplified longitudinal sectional view of the inflow area of a double-flow steam turbine; and FIG. 2 is a cross-sectional view taken along the line II—II of FIG. 1, in the direction of the arrows.

Referring now to FIGS. 1 and 2 of the drawing as a whole, it is seen that steam flows in the direction of an arrow 1 in FIG. 1, radially inwardly through an annular inflow canal 2, which is formed by guide vane carriers 3 and 3' of the flows that are disposed with mirror symmetry relative to an axial center M. The steam, which enters in the radial direction, is then divided equally into two flows, being deflected into the axial direction. However, a small substream is fed into a ring canal 4 which is formed between the shaft 5 and a shaft shield 6 concentric therewith. The ring canal 4 rises somewhat toward both sides starting from the axial center M, due to appropriate construction of the shaft 5 and the shaft shield 6. The shaft shield 6 is fastened to radially inner ends of guide vanes 7 and 7' of a respective first guide vane ring of the two flows. The guide vanes 7 and 7' are in turn inserted into the guide vane carriers 3 and 3'.

A total of four nozzles 8 are placed in the shaft shield 6 in the form of holes which are uniformly distributed over the periphery thereof. As can be seen particularly well from the cross section of FIG. 2, the nozzles 8 are formed in such a way that they open tangentially into the ring canal 4 formed between the shaft 5 and the shaft shield 6, as seen in the direction of rotation of the shaft indicated by an arrow 9. Since the substream or flow-component branched-off from the inflowing steam enters tangentially through the nozzles 8 into the ring canal 4, a swirling or spiral flow indicated by an arrow 10 is developed at that location, which leads or runs ahead of the circumferential velocity of the shaft.

The swirling flow is then divided into two swirling flows starting from the axial center M. The two flows which are indicated in FIG. 1 by arrows 11 and 11', flow along the shaft 5 to rotor blades 12 and 12' of the respective first rotor blade ring of the two flows. The two swirling flows 11 and 11' bypass the guide vanes 7 and 7' of the respective guide vane ring of the two flows. The velocity with which the substream branched-off from the inflowing steam enters the nozzles 8 thereby corresponds to the gradient worked-up in the respective first guide vane ring of the two flows. This input velocity can be increased by constructing the respective first stage as a weak reaction stage.

On one hand, the shaft shield 6 prevents direct exposure of the surface of the shaft 5 to the hot steam flowing in radially in the direction of the arrow 1. On the other hand, the boundary layer temperatures of the swirling flows 10 or 11 and 11' in the ring canal 4 corresponds to the static temperature of the steam, which is lowered by the increase of the kinetic energy, increased by the ram temperature component of the relative velocity between the swirling flow 10 or 11 and 11', respectively, and the circumferential velocity of the shaft. The ram temperature component is small in this case, since the above-mentioned relative velocity is likewise comparatively small due to the chosen orientation of the nozzles 8.

The steam mass flow entering the ring canal 4 through the nozzles 8 is about 3% of the total steam mass flow fed in through the inflow canal 2. The temperature drop in the region of the shaft 5 below the shaft shield 6 is about 20 K. as compared to the temperature of the inflowing steam at the beginning of the swirl field in the axial center M and about 10 to 15 K. at the respective end of the swirl field. The increase in consumption required for this cooling of the shaft is approximately 0.06% and thus corresponds to values obtainable with external cooling by cooling steam introduced from the outside. The slight reduction of the cooling effect at the respective end of the swirl field can optionally be avoided by providing a row of rotor blades additionally disposed on the shaft 5. This row of rotor blades disposed in the axial center M and in the ring canal 4 could advantageously be constructed as a free-jet turbine.

The foregoing is a description corresponding to German application No. P 32 09 506.6, dated Mar. 16, 1982, the International Priority of which is being claimed for the instant application, and which is hereby made part of this application. Any discrepancies between the foregoing specification and the aforementioned corresponding German application are to be resolved in favor of the latter.

I claim:

1. Axial-admission steam turbine, comprising a steam inflow region for receiving inflowing steam, a shaft being rotatable in a given direction, an annular shaft shield being disposed in vicinity of said steam inflow region deflecting the inflowing steam from the radial to the axial direction of said shaft, said annular shaft shield surrounding said shaft at a distance defining a ring canal therebetween, said annular shaft shield having means for cooling the entire periphery of said shaft with an expanded steam layer surrounding the periphery of said shaft, said shaft periphery-surrounding cooling means being in the form of passageways formed in said shaft shield for discharging a portion of steam exclusively from the inflowing steam into said ring canal tangentially relative to said shaft as seen in said given direction of rotation of said shaft.

2. Axial-admission steam turbine, comprising a steam inflow region for receiving inflow steam, guide vane rings including a first guide vane ring, guide vanes of said first guide vane ring having radially inner ends, a shaft being rotatable in a given direction, a stationary annular shaft shield being connected to said radially inner ends of said guide vanes of said first guide vane ring and being disposed in vicinity of said steam inflow region deflecting the inflowing steam from the radial to the axial direction of said shaft, said annular shaft shield surrounding said shaft at a distance defining a ring canal therebetween, said annular shaft shield having means for cooling the entire periphery of said shaft with an expanded steam layer surrounding the periphery of said shaft, said shaft periphery-surrounding cooling means being in the form of nozzles formed in said shaft shield for discharging a portion of steam exclusively from the inflowing steam into said ring canal tangentially relative to said shaft as seen in said given direction of rotation of said shaft.

3. Axial-admission steam turbine according to claim 2, wherein said guide vane rings include another first guide vane ring having guide vanes with radially inner ends, said steam inflow region provides a radial flow of steam being deflected by said shaft shield into two axial flows in opposite directions each being associated with a respective one of said first guide vane rings, said shaft shield is also fastened to said radially inner ends of said guide vanes of said other first guide vane ring, and said nozzles formed in said shaft shield discharge into said ring canal at the axial center of said shaft.

4. Axial-admission steam turbine according to claim 2, including low reaction stages respectively disposed downstream of each of said first guide vane rings.

5. Axial-admission steam turbine according to claim 2, wherein said nozzles are in the form of four nozzles being uniformly distributed over the periphery of said shaft shield.

6. Axial-admission steam turbine according to claim 2, wherein said nozzles have a combined cross section providing a steam mass flow discharging into said ring canal being substantially 3% of the steam mass flow provided in vicinity of said steam inflow region.

* * * * *